US008156967B2

(12) United States Patent
Huffstickler et al.

(10) Patent No.: US 8,156,967 B2
(45) Date of Patent: Apr. 17, 2012

(54) QUICK-DRY TEXTURED TOWEL

(75) Inventors: Carl Melvin Huffstickler, Prosper, TX (US); Karen Wertz, Dallas, TX (US)

(73) Assignee: JC Penney Private Brands, Inc., Plano, TX (US)

( * ) Notice: Subject to any disclaimer, the term of this patent is extended or adjusted under 35 U.S.C. 154(b) by 0 days.

(21) Appl. No.: 13/172,108

(22) Filed: Jun. 29, 2011

(65) Prior Publication Data

US 2011/0253248 A1 Oct. 20, 2011

Related U.S. Application Data

(63) Continuation of application No. PCT/US2010/031084, filed on Apr. 14, 2010.

(60) Provisional application No. 61/169,615, filed on Apr. 15, 2009.

(51) Int. Cl.
*D03D 27/08* (2006.01)
*D03D 39/22* (2006.01)
*D03D 39/00* (2006.01)

(52) U.S. Cl. ..... 139/396; 139/21; 139/25; 139/383 R; 139/391

(58) Field of Classification Search ..... 139/21, 139/25, 116.5, 383 R, 391, 396, 420 R
See application file for complete search history.

(56) References Cited

U.S. PATENT DOCUMENTS

| | | | | |
|---|---|---|---|---|
| 793,524 | A * | 6/1905 | Hewett | 139/384 R |
| 1,998,041 | A * | 4/1935 | Barbet | 139/384 R |
| 2,231,388 | A * | 2/1941 | Kahil | 139/384 R |
| 2,352,067 | A * | 6/1944 | Barr | 139/396 |
| 2,424,928 | A * | 7/1947 | Glendinning et al. | 139/384 R |
| 2,860,669 | A * | 11/1958 | Moberg | 139/402 |
| 2,997,074 | A * | 8/1961 | Law | 139/396 |
| 3,030,691 | A * | 4/1962 | Law | 428/89 |
| 3,357,075 | A * | 12/1967 | Law | 28/160 |
| 3,721,272 | A * | 3/1973 | Hager | 139/396 |
| 4,576,848 | A * | 3/1986 | Dillon et al. | 428/89 |
| 4,984,606 | A * | 1/1991 | Moore et al. | 139/25 |
| 5,336,543 | A * | 8/1994 | Pyle | 428/78 |
| 6,062,272 | A * | 5/2000 | Waite | 139/420 A |
| 7,673,656 | B2 * | 3/2010 | Heiman | 139/391 |
| 2004/0131821 | A1 | 7/2004 | Mandawewala | |
| 2004/0159363 | A1 * | 8/2004 | Foil et al. | 139/416 |
| 2005/0069672 | A1 * | 3/2005 | Katsin | 428/88 |
| 2005/0241093 | A1 * | 11/2005 | McKenzie | 15/209.1 |
| 2007/0226934 | A1 * | 10/2007 | Bohannon et al. | 15/209.1 |
| 2009/0078330 | A1 * | 3/2009 | Wang | 139/25 |
| 2009/0151105 | A1 * | 6/2009 | Bohannon et al. | 15/210.1 |

FOREIGN PATENT DOCUMENTS

| | | | |
|---|---|---|---|
| GB | 502303 | A | 3/1939 |
| JP | 6-264329 | A | 9/1994 |
| JP | 5-230738 | A | 7/2004 |

* cited by examiner

*Primary Examiner* — Bobby Muromoto, Jr.

(57) ABSTRACT

A quick-dry textured towel is disclosed. The quick-dry textured towel comprises a lightweight fabric including a plurality of low-twist pile yarns forming a textured weave design.

13 Claims, 2 Drawing Sheets

QUICK-DRY TEXTURED TOWEL

CROSS REFERENCE TO RELATED APPLICATIONS

This application is a continuation of PCT Application Serial No. PCT/US2010/031084, filed on Apr. 14, 2010, entitled "Quick-Dry Textured Towel" which claims the benefit of U.S. Provisional Application Ser. No. 61/169,615, filed Apr. 15, 2009. This application is also related to U.S. patent application Ser. No. 12/759,364, filed on Apr. 13, 2010 of which all of the disclosures are hereby incorporated by reference.

TECHNICAL FIELD

The invention relates in general to towels, and in particular to quick drying towels.

BACKGROUND INFORMATION

Towels are typically used for drying. Accordingly, commercially available towels are designed for maximum absorption. At maximum absorption, it has been observed that commercially available towels weigh more than desirable, and also require longer than desirable drying times. One approach to reducing towel drying times and weight is to reduce the aesthetic properties (e.g., look and feel) of the towels, such as towels' bulk and softness. However, consumers desire aesthetically pleasing towels with quick drying times. Although commercially available towels have been generally adequate for the intended purposes, they have not been entirely satisfactory in all respects.

What is needed, therefore, is an aesthetically pleasing towels with quick drying times.

SUMMARY

In response to these and other problems, in one embodiment, there is a quick dry towel, comprising a woven ground fabric comprising a plurality of warp yarns substantially parallel to each other, a plurality of weft yarns substantially parallel to each other and intersecting the plurality of warp yarns such that the plurality of weft yarns are substantially perpendicular to the plurality of warp yarns; a plurality of pile weave portions extending from the woven ground fabric; a plurality of flat weave portions alternating between the pile weave portions to form a diagonal design extending across a substantial portion of the towel, wherein the pile weave portions comprise terry loop yarns raised above the woven ground fabric to form terry loops where the loop is substantially wider the terry loop yarn, and the terry loop yarns comprise zero twist yarns such that a fabric weight of the towel is less than 350 g/m2.

These and other features, and advantages, will be more clearly understood from the following detailed description taken in conjunction with the accompanying drawings. It is important to note the drawings are not intended to represent the only aspect of the invention.

The present disclosure is best understood from the following detailed description when read with the accompanying figures. It is emphasized that, in accordance with the standard practice in the industry, various features are not drawn to scale and are used for illustration purposes only. In fact, the dimensions of the various features may be arbitrarily increased or reduced for clarity of discussion

DETAILED DESCRIPTION

Figure 1A:
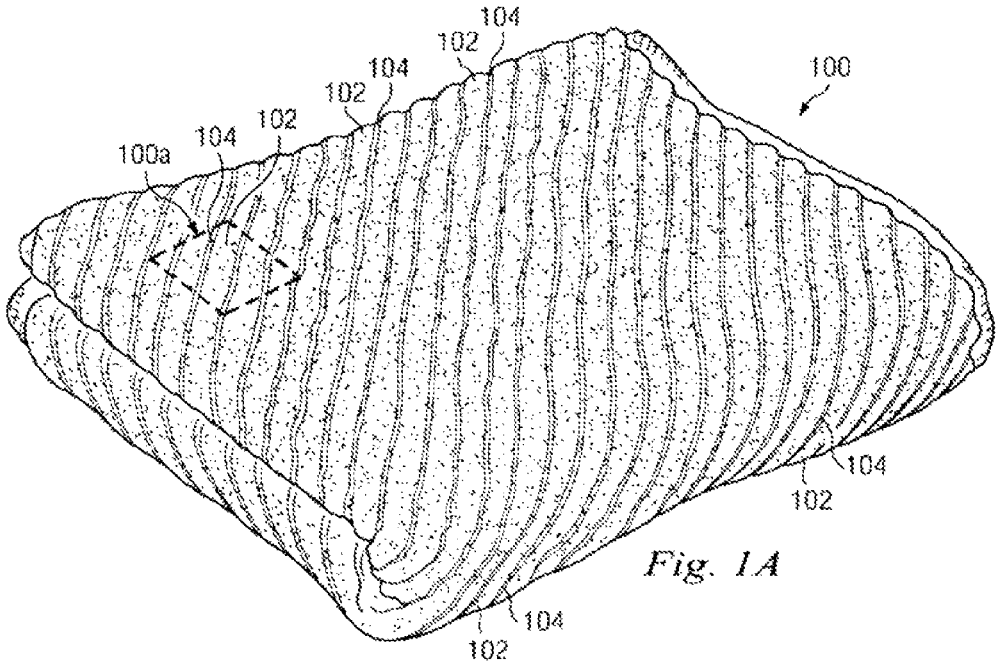
FIG. 1A is a diagrammatic view of a quick-dry textured towel according to an embodiment of the present invention.

For the purposes of promoting an understanding of the principles of the present inventions, reference will now be made to the embodiments, or examples, illustrated in the drawings and specific language will be used to describe the same. It will nevertheless be understood that no limitation of the scope of the invention is thereby intended. Any alterations and further modifications in the described embodiments, and any further applications of the principles of the inventions as described herein are contemplated as would normally occur to one skilled in the art to which the invention relates.

Figure 1B:
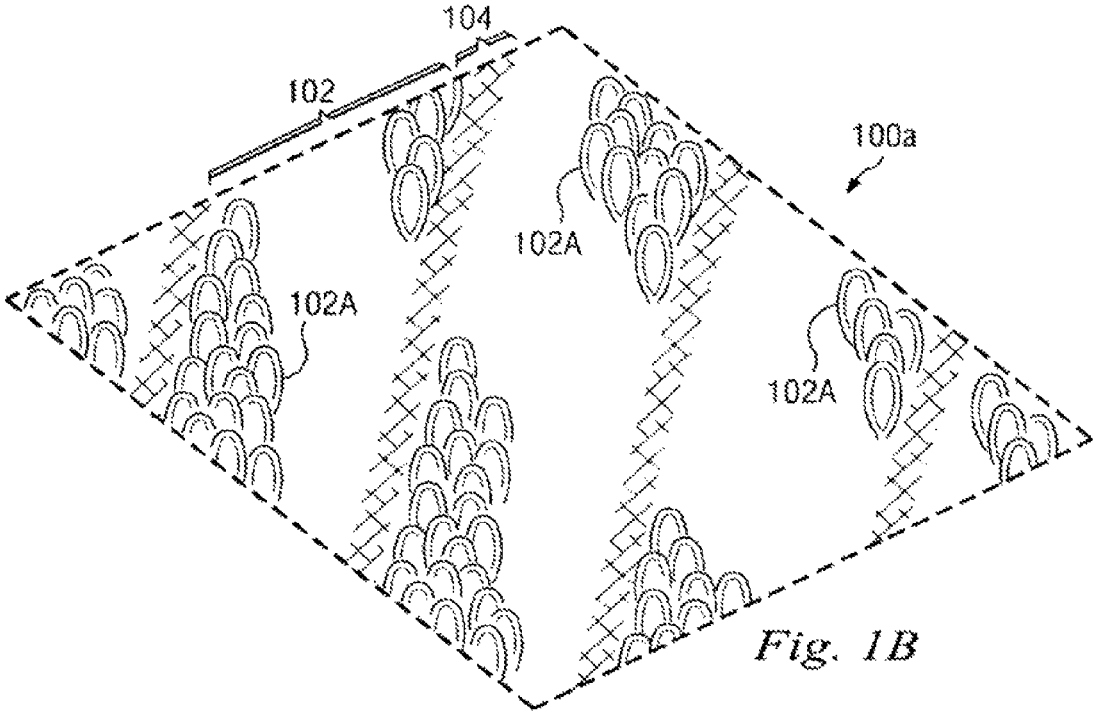
FIG. 1B is a diagrammatic view of a surface portion of the quick-dry textured towel of FIG. 1A.
Figure 2:
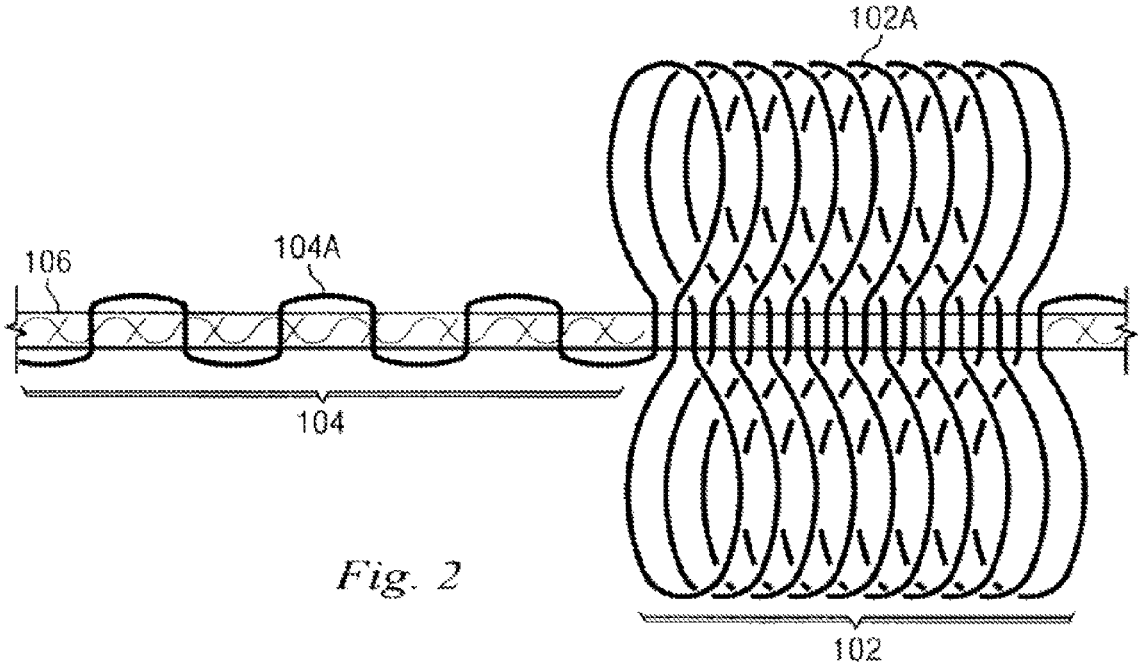
FIG. 2 is a diagrammatic cross-sectional view of a portion of the quick-dry textured towel of FIG. 1A.

The present disclosure relates generally to towels, and more particularly, to a quick-dry textured towel. FIG. 1A is a diagrammatic view of a quick-dry textured towel 100 according to an embodiment of the present disclosure, FIG. 1B is a diagrammatic view of a surface portion 100A of the quick-dry textured towel 100 of FIG. 1A, and FIG. 2 is a diagrammatic cross-sectional view of a portion of the quick-dry textured towel 100 of FIG. 1A. The quick-dry textured towel 100 includes a lightweight fabric with a textured weave design. The textured weave design is achieved by alternating pile-weave portions 102 and flat-weave portions 104. The alternating pile-weave portions 102 and flat-weave portions 104 can extend along the length and/or width of the towel. The alternating textured weave design may extend substantially over one or both surfaces of the towel 100. The textured weave design can also be in designated areas of the towel 100 to achieve ornamental design. For example, the alternating textured weave design can extend diagonally with respect to the length and/or width of the towel. The textured weave design gives the quick-dry towel 100 a bulky, soft appearance despite its lightweight.

In the depicted embodiment, the pile-weave portions 102 are sandwiched between flat-weave portions 104. The alternating pile-weave portions 102 and flat weave portions 104 extend from a woven ground fabric 106 of the quick-dry textured towel 100. A "woven fabric" can include fabric made by interlacing two or more systems of yarns at essentially right angles to each other. For example, the woven ground fabric 106 can include a set of warp yarns and a set of weft (or filling) yarns intersecting and locked together. The set of warp yarns are substantially parallel to each other and the set of weft yarns are substantially parallel to each other. The set of warp yarns and set of weft yarns are substantially perpendicular to each other. The set of warp yarns are periodically interlaced with the set of weft yarns to form the woven ground fabric 106. The woven ground fabric 106 may be a plain or twill weave construction.

The pile-weave portions 102 include a plurality of pile yarns 102A, and the flat weave portions 104 include a plurality of yarns 104A. As illustrated in FIG. 2, the pile yarns 102A and yarns 104A extend outwardly from at least one surface of the woven ground fabric 106. In the present embodiment, the yarns 102A extend further from the surface of the ground fabric 106 than the yarns 104A. Alternatively, the flat-weave portions 104 may not include yarns 104A, instead comprising the portions of the woven ground fabric 106 that do not have the pile yarns 102A extending therefrom. In yet another alternative, the pile yarns 102A and/or yarns 104A include yarns that extend varying distances from the woven ground fabric 106.

The pile yarns 102A and/or yarns 104A may be formed as additional warp yarns interspersed between the ground warps and interlaced with the weft yarns as known in the art, such that the yarns are tied into the woven ground fabric 106. "Pile" are raised loops or cut loops that form a surface of a pile fabric. A pile fabric is a fabric having tufts protruding from a backing, such as the woven ground fabric 106. In the present embodiment, the pile yarns 102A extend from the ground fabric in the form of one or more terry loops. The yarns 104A can also extend from the ground fabric in the form of one or more terry loops. As illustrated in FIG. 2, the terry loop yarns 104A may comprise a substantially wider loop than the terry loop yarns 102A. Alternatively, the pile yarns 102A and/or yarns 104A may extend from the woven ground fabric 106 in the form of cut ends. The pile yarns 102A of the quick-dry textured towel 100 comprise low-twist yarn. The low-twist yarn may be zero twist yarn. In the depicted embodiment, the pile yarns 102A comprise a zero twist terry yarn. The textured weave design opens up the terry loops to facilitate faster drying.

The quick-dry textured towel 100 comprises any suitable material. In the present embodiment, the towel 100 comprises substantially all cotton, for example, 100% cotton. The towel 100 may comprise other materials, such as polyester or rayon. Alternatively, the quick-dry textured towel 100 comprises one or a combination of combination of cotton, polyester, rayon, silk, wool, and/or other suitable man-made and/or natural materials.

In summary, the quick-dry textured towel 100 includes a lightweight fabric including a plurality of low-twist pile yarns in a texture weave design. The lightweight fabric includes a fabric weight of less than about 350 g/m$^2$. It has been observed that a direct relationship exists between a weight of a towel and its dry rate. For example, Table 1 below compares the quick-dry textured towel 100 of the present disclosure to commercially available towels.

TABLE 1

| Sample | Dry Time | Fabric Weight (g/m$^2$) | Total Size |
|---|---|---|---|
| Quick-Dry Textured Towel | 20 min. | 345 | 30.4" × 54.7" |
| Towel # 1 | 20 min. | 398 | 24.4" × 41.3" |
| Towel # 2 | 20 min. | 352 | 24.5" × 44.3" |
| Towel #3 | 35 min. | 491 | 25.5" × 48.5" |

TABLE 1-continued

| Sample | Dry Time | Fabric Weight (g/m$^2$) | Total Size |
|---|---|---|---|
| Towel # 4 | 30 min. | 612* | 30" × 56" |
| Towel # 5 | 30 min. | 602* | 30" × 56" |
| Towel # 6 | 30 min. | 610 | 30.6" × 54.8" |
| Towel # 7 | 25 min. | 481 | 39.1" × 71.1" |

Table 1 provides a dry time, fabric weight, and total size of each towel. The dry time represents the total time required for the towel to dry in minutes. The fabric weight, illustrated in grams per square meter of towel (g/m$^2$), is determined from the total weight and total size of the towel. The total size for the towel represents the length and width of the towel in inches. As evident from Table 1, the quick-dry textured towel exhibits one of the quickest drying times (e.g., 20 minutes) while maintaining the lightest fabric weight (e.g., 345 g/m$^2$). It should be noted that from Table 1 above that while the fabric weight (g/m$^2$) for Towel 1 and 2 are similar, the size, hand feel, loft, bulk, and absorbency of the quick-dry textured towel 100 is superior and significantly different from Towels 1 and 2.

Table 2 below also compares the quick-dry textured towel 100 of the present embodiment to commercially available towels, specifically providing test results related to a weight of each towel while drying.

TABLE 2

| | | Quick-Dry Textured Towel | Towel # 1 | Towel # 2 | Towel # 3 | Towel # 4 | Towel # 5 | Towel # 6 | Towel # 7 |
|---|---|---|---|---|---|---|---|---|---|
| TIME (minutes) | 0 | 25.182 | 24.221 | 25.828 | 46.591 | 42.58 | 41.14 | 44.04 | 35.172 |
| | 5 | 19.884 | 19.514 | 20.947 | 41.517 | 37.54 | 35.29 | 39.25 | 30.116 |
| | 10 | 15.985 | 15.657 | 17.281 | 35.630 | 32.58 | 30.02 | 34.52 | 25.077 |
| | 15 | 13.307 | 14.307 | 15.360 | 29.686 | 29.48 | 26.33 | 30.60 | 21.232 |
| | 20 | 12.632 | 14.194 | 15.044 | 24.851 | 27.16 | 24.01 | 27.47 | 18.926 |
| | 25 | | | | 21.686 | 25.74 | 22.78 | 25.34 | 18.301 |
| | 30 | | | | 19.950 | 25.30 | 22.49 | 24.34 | |
| | 35 | | | | 19.628 | | | | |
| | 40 | | | | | | | | |

Figure 3:
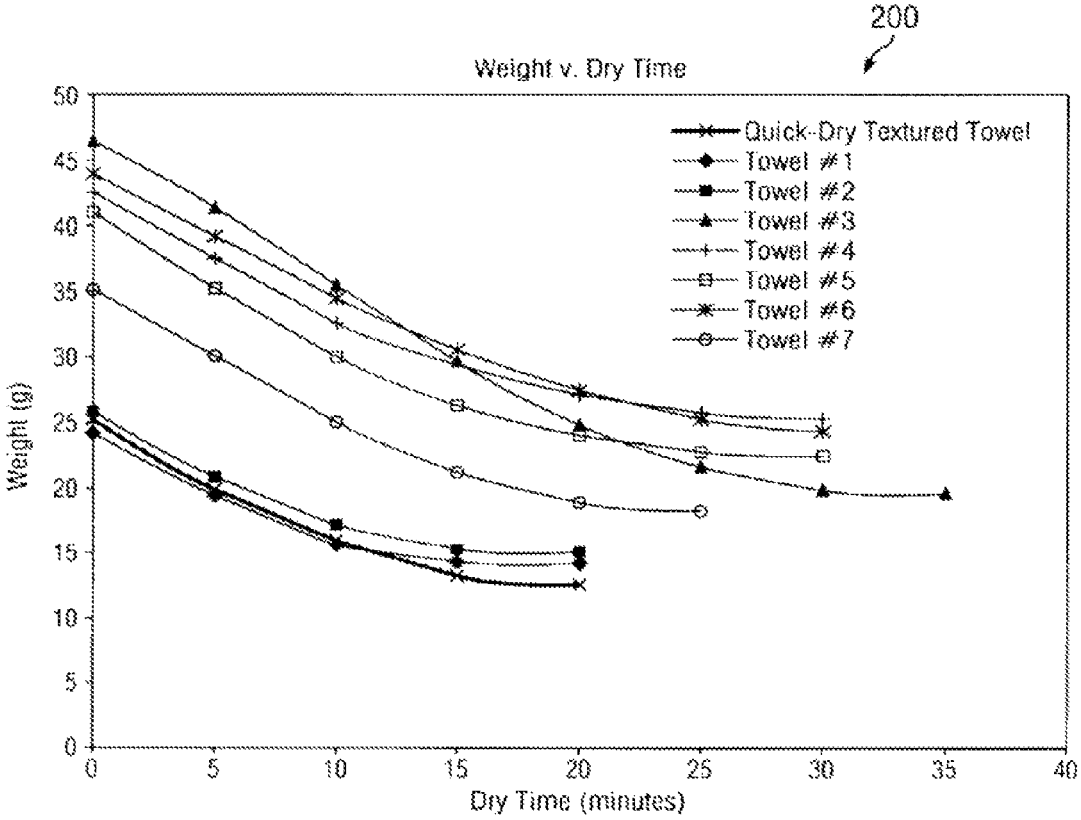
FIG. 3 is a graph illustrating quick-dry and lightweight properties of the quick-dry textured towel of FIG. 1A.

The weight of each towel was measured in grams at 5-minute time intervals. For example, the quick-dry textured towel 100 took 20 minutes to dry. The quick-dry textured towel began with a weight of 25.182 grams and ended with a weight of 12.632 grams when dry. From Table 2, it is evident that the quick-dry textured towel weighs substantially less when wet and dry as compared to other towels. FIG. 3 is a graph 200 that corresponds with Table 2 and illustrates the quick-dry and lightweight properties of the quick-dry textured towel 100. From FIG. 3, it is clear that the quick-dry textured towel weighs substantially less when wet and dry as compared to other towels, while drying quicker than commercially available towels.

Although the specific description herein focuses on a towel embodiment, the same features are applicable to other items, including blankets, sheets, clothing, bathrobes, wraps, beach towels, hair towels, accessories, shoes, swimwear, carpets, or any other suitable item. It is understood that the present disclosure provides many different embodiments, or examples, for implementing different features of the invention. Specific examples of components and arrangements are described above to simplify the present disclosure. These are, of course, merely examples and are not intended to be limiting. Further, the foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

The abstract of the disclosure is provided for the sole reason of complying with the rules requiring an abstract, which will allow a searcher to quickly ascertain the subject matter of the technical disclosure of any patent issued from this disclosure. It is submitted with the understanding that it will not be used to interpret or limit the scope or meaning of the claims.

Any advantages and benefits described may not apply to all embodiments of the invention. When the word "means" is recited in a claim element, Applicant intends for the claim element to fall under 35 USC 112, paragraph 6. Often a label of one or more words precedes the word "means". The word or words preceding the word "means" is a label intended to ease referencing of claims elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word means are not intended to fall under 35 USC 112, paragraph 6.

The foregoing description of the embodiments of the invention has been presented for the purposes of illustration and description. It is not intended to be exhaustive or to limit the invention to the precise form disclosed. Many combinations, modifications and variations are possible in light of the above teaching. For instance, in certain embodiments, each of the above described components and features may be individually or sequentially combined with other components or features and still be within the scope of the present invention. Undescribed embodiments which have interchanged components are still within the scope of the present invention. It is intended that the scope of the invention be limited not by this detailed description, but rather by the claims.

What is claimed is:

1. A quick dry towel, comprising:
a woven ground fabric comprising:
a plurality of warp yarns substantially parallel to each other,
a plurality of weft yarns substantially parallel to each other and intersecting the plurality of warp yarns such that the plurality of weft yarns are substantially perpendicular to the plurality of warp yarns;
a plurality of pile weave portions extending from the woven ground fabric;
a plurality of flat weave portions alternating between the pile weave portions to form a diagonal design extending across a substantial portion of the towel,
wherein the pile weave portions comprise:
terry loop yarns raised above the woven ground fabric to form terry loops where the loop is substantially wider the terry loop yarn, and
the terry loop yarns comprise zero twist yarns;
such that a fabric weight of the towel is less than 350 g/m$^2$ and wherein the weave design texture opens up the terry loops to facilitate quick drying.

2. The quick dry towel of claim 1, wherein the towel comprises substantially cotton yarns.

3. The quick dry towel of claim 1, wherein the towel comprises yarns selected from the group consisting of polyester, rayon, silk, and wool.

4. The quick dry towel of claim 1, wherein the zero twist pile yarns comprise low twist pile yarns.

5. A quick dry towel, comprising:
a woven ground fabric comprising:
a plurality of warp yarns substantially parallel to each other,
a plurality of weft yarns substantially parallel to each other and intersecting the plurality of warp yarns such that the plurality of weft yarns are substantially perpendicular to the plurality of warp yarns;
a plurality of longitudinal pile weave portions extending from the woven ground fabric;
a plurality of longitudinal flat weave portions alternating between the pile weave portions to form a longitudinal design extending across a substantial portion of the towel,
wherein the pile weave portions comprise:
terry loop yarns raised above the woven ground fabric to form terry loops where the loop is substantially wider the terry loop yarn, and
the terry loop yarns comprise zero twist yarns;
such that a fabric weight of the towel is less than 350 g/m$^2$ and wherein the weave design texture opens up the terry loops to facilitate quick drying.

6. The quick dry towel of claim 5, wherein the towel comprises substantially cotton yarns.

7. The quick dry towel of claim 5, wherein the towel comprises yarns selected from the group consisting of polyester, rayon, silk, and wool.

8. The quick dry towel of claim 5, wherein the zero twist pile yarns comprise low twist pile yarns.

9. A quick dry towel, comprising:
a woven ground fabric comprising:
a plurality of warp yarns substantially parallel to each other,
a plurality of weft yarns substantially parallel to each other and intersecting the plurality of warp yarns such that the plurality of weft yarns are substantially perpendicular to the plurality of warp yarns;
a plurality of pile weave portions extending from the woven ground fabric;
a plurality of flat weave portions alternating between the pile weave portions to form a stripe design extending across a substantial width of the towel,
wherein the pile weave portions comprise:
terry loop yarns raised above the woven ground fabric to form terry loops where the loop is substantially wider the terry loop yarn, and
the terry loop yarns comprise zero twist yarns;
such that a fabric weight of the towel is less than 350 g/m$^2$ and wherein the weave design texture opens up the terry loops to facilitate quick drying.

10. The quick dry towel of claim 9, wherein the warp yarns and weft yarns of the woven ground fabric comprise substantially cotton yarns.

11. The quick dry towel of claim 9, wherein the towel comprises substantially cotton yarns.

12. The quick dry towel of claim 9, wherein the towel comprises yarns selected from the group consisting of polyester, rayon, silk, and wool.

13. The quick dry towel of claim 9, wherein the zero twist pile yarns comprise low twist pile yarns.

* * * * *